US009758271B2

(12) United States Patent
Hermel

(10) Patent No.: US 9,758,271 B2
(45) Date of Patent: Sep. 12, 2017

(54) CONTAINER HAVING A BOTTOM PROVIDED WITH A VAULT WITH A DOUBLE INDENTATION

(71) Applicant: SIDEL PARTICIPATIONS, Octeville sur Mer (FR)

(72) Inventor: Wilfried Hermel, Octeville sur Mer (FR)

(73) Assignee: SIDEL PARTICIPATIONS, Octeville sur Mer (FR)

( * ) Notice: Subject to any disclaimer, the term of this patent is extended or adjusted under 35 U.S.C. 154(b) by 0 days.

(21) Appl. No.: 14/646,618

(22) PCT Filed: Nov. 13, 2013

(86) PCT No.: PCT/FR2013/052730

§ 371 (c)(1),
(2) Date: May 21, 2015

(87) PCT Pub. No.: WO2014/083255

PCT Pub. Date: Jun. 5, 2014

(65) Prior Publication Data

US 2015/0298848 A1 Oct. 22, 2015

(30) Foreign Application Priority Data

Nov. 30, 2012 (FR) ..... 12 61523

(51) Int. Cl.
*B65D 1/02* (2006.01)
*B65D 1/42* (2006.01)

(52) U.S. Cl.
CPC ..... *B65D 1/0284* (2013.01); *B65D 1/42* (2013.01); *B65D 2501/0036* (2013.01)

(58) Field of Classification Search
CPC B65D 1/0284; B65D 1/42; B65D 2501/0036; B65D 1/0261; B65D 1/0276; B65D 79/005
(Continued)

(56) References Cited

U.S. PATENT DOCUMENTS 4,249,666 A 2/1981 Hubert et al.
5,145,632 A 9/1992 Denis et al.
(Continued)

FOREIGN PATENT DOCUMENTS

EP 0 572 722 A1 12/1993
EP 2 133 277 A1 12/2009
(Continued)

OTHER PUBLICATIONS

International Search Report, dated Feb. 7, 2014, from corresponding PCT application.

*Primary Examiner* — Stephen Castellano
(74) *Attorney, Agent, or Firm* — Young & Thompson

(57) ABSTRACT

Disclosed is a container made of plastics material, which is provided with a body and a bottom (6) that extends from a lower end of the body, the bottom (6) including: a peripheral base (7) that defines a setting-down plane (8); a concave vault (10) which extends from a central area (11), forming a peg that projects towards the inside of the container, to the base (7); a set of main reinforcing grooves (13) which extend radially from the central area (11) as far at least as the base (7), wherein, in the container, the vault (10) has a central region (15), a median region (16) and a peripheral region (17) that are each separated by an internal axial indentation (18) and an external axial indentation (19) which extend annularly in a continuous manner around the central area (11).

20 Claims, 3 Drawing Sheets

(58) Field of Classification Search
USPC ..... 220/608; 215/375
See application file for complete search history.

(56) References Cited

U.S. PATENT DOCUMENTS

| | | | | |
|---|---|---|---|---|
| 2002/0063105 | A1* | 5/2002 | Darr | B65D 1/0276 215/373 |
| 2009/0308835 | A1 | 12/2009 | Boukobza | |

FOREIGN PATENT DOCUMENTS

| | | | |
|---|---|---|---|
| FR | 2 382 373 | A1 | 9/1978 |
| FR | 2 649 035 | A | 1/1991 |
| JP | S62 28335 | A | 2/1987 |
| JP | H08 104313 | A | 4/1996 |

* cited by examiner

FIG.3
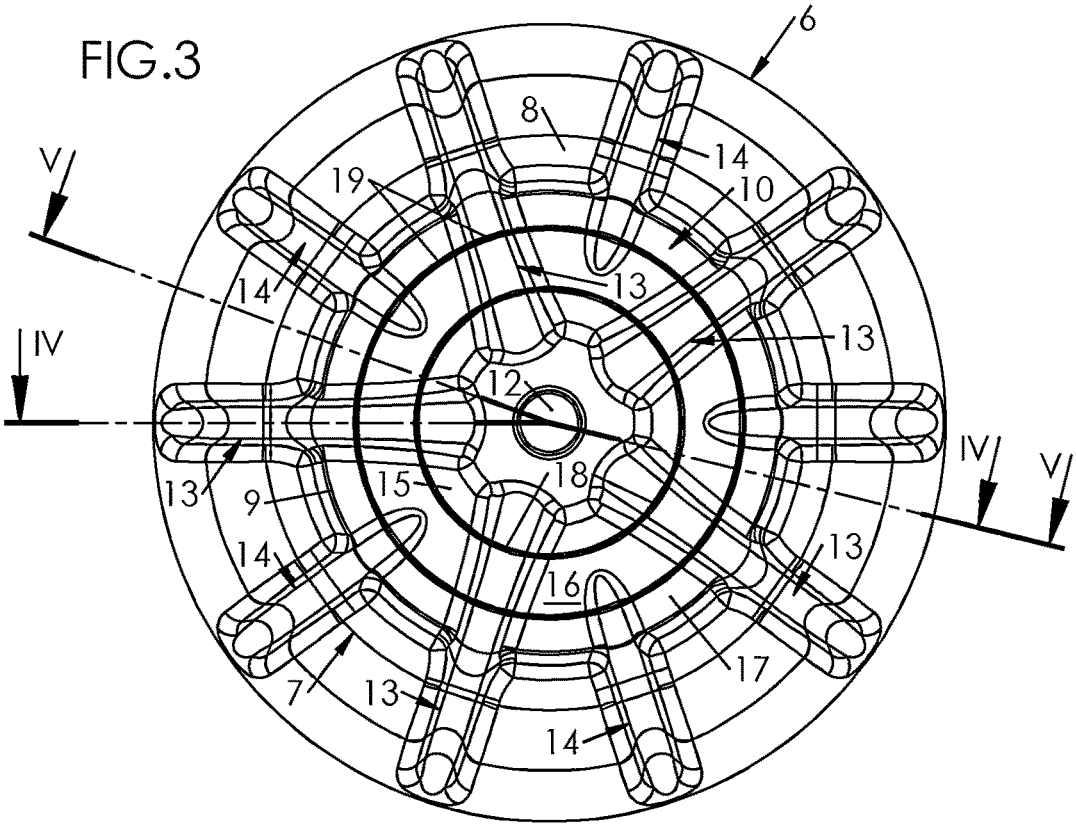
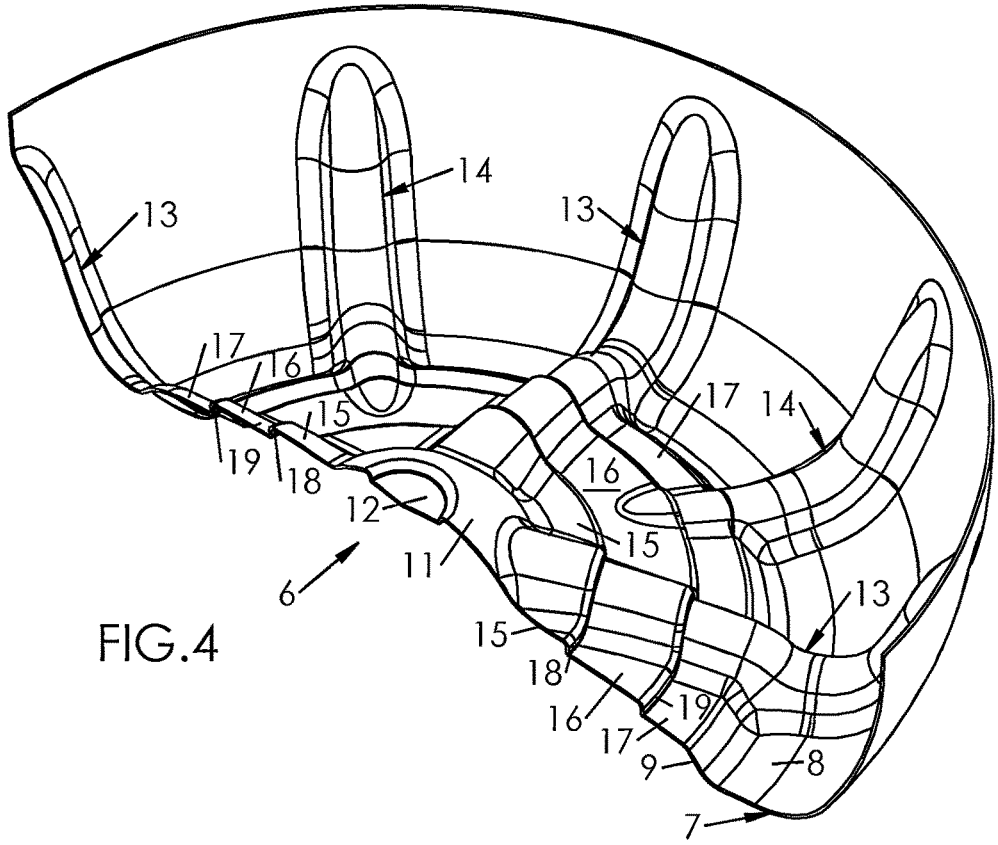
FIG.4

CONTAINER HAVING A BOTTOM PROVIDED WITH A VAULT WITH A DOUBLE INDENTATION

This application is the national stage (Rule 371) of PCT/FR2013/052730 filed Nov. 13, 2013.

BACKGROUND OF THE INVENTION

The invention relates to producing containers, particularly bottles or jars, obtained by blow-molding or stretch-blow molding from preforms of plastic material, such as polyethylene terephthalate (PET).

DESCRIPTION OF THE RELATED ART

Producing a container by blow molding ordinarily consists in introducing into a mold having the shape of the container a blank (a preform or an intermediate container obtained by pre-blow molding of a preform) that has been previously heated to a temperature that is higher than the glass transition temperature of the material, and in injecting into the blank a fluid (particularly a gas such as air) under pressure. The blow molding can be completed by a preliminary stretching of the blank by means of a sliding rod.

The double molecular orientation that the material undergoes during the blow molding (axial and radial, or parallel and perpendicular to the general axis of the container) imparts to the container a certain structural stiffness.

The market, however, dictates a reduction in the weight of the containers. The objective is two-fold: economic (to reduce costs) and ecological (to reduce the environmental footprint), by reducing the amount of material used, and reducing the blow-molding pressures.

Since the demands of the market in terms of mechanical performance remain the same, however, the manufacturers, to stiffen their containers, are forced to resort to manufacturing tricks, the bi-orientation proving to be insufficient.

A well-known method for increasing the stiffness of a container is heat-setting, which consists in heating the wall of the mold to increase the rate of crystallinity by means of heat. This method, illustrated by the French patent FR2649035 (Sidel) and its U.S. equivalent U.S. Pat. No. 5,145,632, is essentially used for HR (initials for the English term "heat-resistant," or resistant to heat) applications, in which the container is hot-filled.

Because of its cost and because of the reduction in speed that it requires, however, this type of method could not be generalized to the ordinary applications of the still water type. For these applications, the demand for reducing weight is dramatic. By way of example, the current specifications for the forming of a bottle with a capacity of 0.5 liter, intended to receive still water, more and more frequently require a weight that is less than or equal to 10 g, for a blow-molding pressure that is less than or equal to 20 bar.

Under normal fill conditions, such a container has a wall flexibility such that it is difficult to palletize it without danger of collapsing the pallet. Actually, considering the high vertical compression stresses that accumulate on the containers of the lower rows of the pallet, these containers present a high risk of buckling.

It is known to stiffen the wall of a filled container by putting it under pressure, for example by means of a drop of liquid nitrogen introduced after filling and before capping, and whose evaporation causes an overpressure in the container. This trick, however, necessitates structurally stiffening the bottom, on which the stresses in fact are concentrated.

It is known to stiffen the bottom by means of radial grooves, cf., for example, the European patent EP2133277 or the equivalent U.S. patent application US2009308835 (Sidel). The presence of grooves, however, consumes material and requires a relatively high blow-molding pressure to make possible a good taking of shape: two constraints that it is specifically desired to eliminate.

Because in theory it would be possible to increase the mechanical strength of the bottom (particularly its resistance to popping out) by increasing the depth of the grooves or of the vault itself. However, this trick of shape, as effective as it is, requires at the same time additional material, which is incompatible with the above-mentioned requirements for reducing weight, and a high blow-molding pressure, which is incompatible with the requirements for energy savings, which assume on the contrary a reduction of blow-molding pressure necessary for the forming of the container.

SUMMARY OF THE INVENTION

A first objective is to improve the mechanical performance of the containers to equivalent blow-moldability (i.e., the ability of the container to be formed by blow-molding).

A second objective is to propose a container whose optimized shape of the bottom gives it a good compromise between blow-moldability, weight reduction, and stiffness.

A third objective is to propose a container whose bottom offers a good resistance to inversion, and which, under conditions of high pressure, can remain stable.

For this purpose, a container of plastic material is proposed that is provided with a body and with a bottom extending from a lower end of the body, the bottom comprising:

- a peripheral footing that defines a contact plane;
- a concave vault that extends from a central area;
- a series of main reinforcing grooves that extend radially from the central area to at least the footing;

the vault having three concentric regions, namely a central region, a middle region and a peripheral region, separated respectively by an inner axial step and an outer axial step that extend annularly in a continuous manner around the central area, ensuring that the central region is raised relative to the middle region, and that the middle region is raised relative to the peripheral region.

Thanks to this double step, the bottom has an increased resistance to inversion, without it being necessary to increase the depth of the grooves or of the vault itself. This improvement of the performance of the bottom is consequently achieved without appreciable degradation of its blow-moldability, and without appreciable increase of material.

Various additional characteristics can be foreseen, alone or in combination:

- each step has a height that is less than 4% of an outer diameter of the contact plane;
- each step has a height of about 3% of the outer diameter of the contact plane;
- each step extends over a height of about 1 mm;
- the inner step has a diameter of between 30% and 40% of an outer diameter of the contact plane;
- the diameter of the inner step is about 37% of the diameter of the contact plane;
- the outer step has a diameter of between 50% and 60% of an outer diameter of the contact plane;

the diameter of the outer step is about 54% of the diameter of the contact plane;

the main reinforcing grooves extend radially beyond the footing;

the bottom comprises a series of interposed reinforcing grooves, which extend locally straddling the footing.

BREIF DESCRIPTION OF THE DRAWING FIGURES

Other objects and advantages of the invention will come to light from the description of an embodiment, made hereafter with reference to the accompanying drawings in which:

FIG. 3 is a plan view from below showing the bottom of the container;

FIG. 4 is a cross-sectional view, in perspective, of the bottom of FIG. 3, along the cutting plane IV-IV;

DETAILED DESCRIPTION OF THE INVENTION

Figure 1:
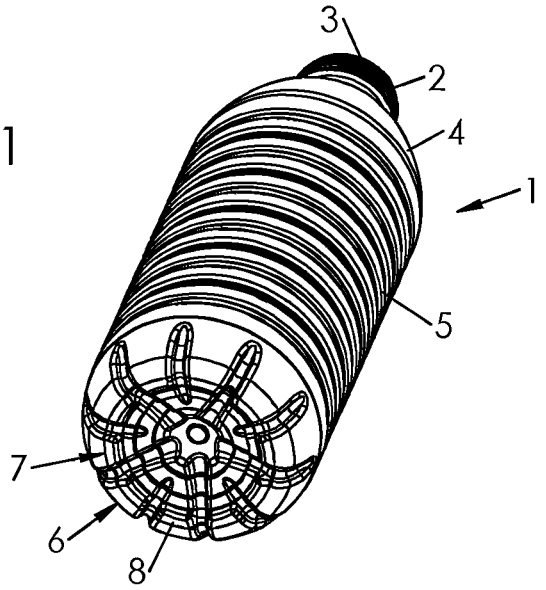
FIG. 1 is a view in perspective from below of a container made of plastic material.

In FIG. 1, a container 1 is represented, in this case a bottle, made by stretch-blow molding from a preform of thermoplastic material, for example PET (polyethylene terephthalate).

This container 1 comprises, at an upper end, a neck 2, provided with a spout 3. In the extension of the neck 2, the container 1 comprises in its upper part a shoulder 4 that while flaring out goes in the direction opposite to the neck 2, this shoulder 4 being extended by a side wall or body 5, of generally cylindrical shape rotationally around a main axis X of the container 1.

The container 1 further comprises a bottom 6 that extends opposite the neck 2, from a lower end of the body 5. The bottom 6 comprises a peripheral footing 7 in the shape of an annular rim that extends approximately axially into the extension of the body 5. The footing 7 ends by a contact plane 8 that is perpendicular to the axis X of the container 1, which contact plane 8 defines the lower end of the container 1 and makes it possible for it to be placed, upright, on a plane surface.

The outer diameter of the contact plane 8 is denoted D, the term "diameter" covering not only the case (shown) where the container 1 (and therefore the bottom 6) must have a circular contour, but also the case where the container 1 would have a polygonal contour (for example, square), in which case the term "diameter" would designate the diameter of the circle that would be inscribed in this polygon. In the example shown, corresponding to a container with a capacity of 0.5 liter, this diameter D is about 45 mm.

Toward the interior of the container 1, the footing 7 comprises an annular rim 9 in the shape of a truncated cone that extends toward the interior of the container 1 in the extension of the contact plane 8, the truncated cone formed by the rim 9 opening downward (in relief) and having a peak angle of at least 70°. This rim 9 can have a height of between 1.5 mm and 2.5 mm, for example about 2 mm.

The bottom 6 further comprises a concave vault 10, in the shape of an approximately spherical dome with concavity turned toward the outside of the container 1, in the absence of stress, i.e., in the absence of contents in the container 1. The vault 10 extends from the footing 7, into the extension of the rim 9, to a central area 11 of the bottom 6 forming a piece projecting toward the interior of the container 1, with—in its center—an amorphous button 12 that corresponds to the injection area of the material that makes up the preform that has been used to make the container. In practice, the button performs a centering function during the forming of the container 1 (by blow molding or stretch-blow molding).

Figure 2:
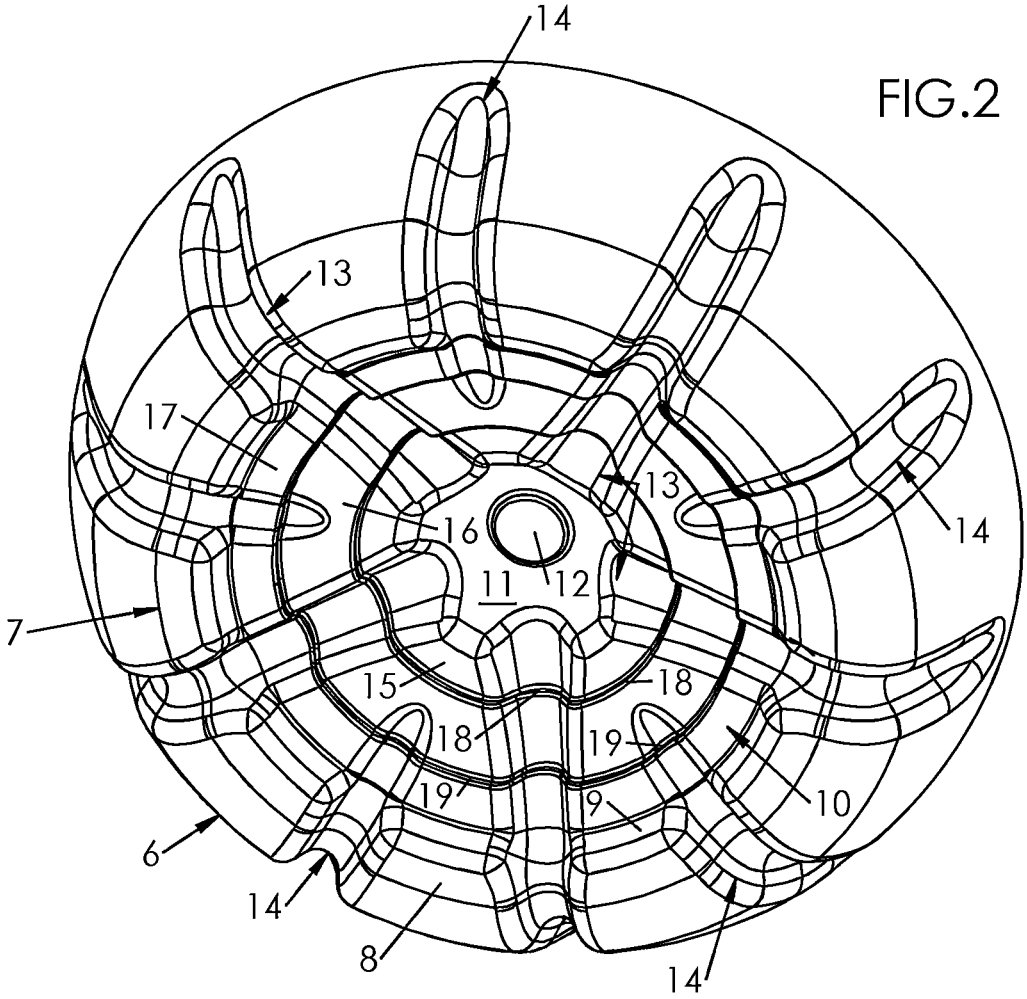
FIG. 2 is a view in perspective, on a larger scale, showing the bottom of the container of FIG. 1.

As can be seen in the Figures, and in particular in FIG. 2, the bottom 6 comprises a series of main reinforcing grooves 13 that are formed recessed toward the inside of the container 1, which extend radially from the central area 11 to at least the footing 7. According to a preferred embodiment, illustrated in the figures, the main reinforcing grooves 13 extend radially beyond the footing 7, rising laterally on a lower part of the body 5.

In other words, the main grooves 13 extend radially over the entire vault 10, straddling the footing 7 and partially onto the body 5. Consequently, it is understood that the contact plane 8 is discontinuous, since it is interrupted at right angles to each main groove 13. The main grooves 13 are, for example, five in number (as in the example illustrated, which corresponds to a container with a capacity of about 0.5 liter), but this number could be greater, particularly six in the case of a container with a capacity that is greater than or equal to 1 liter, or else seven in the case of a container with a capacity that is greater than or equal to 2.5 liters.

Figure 5:
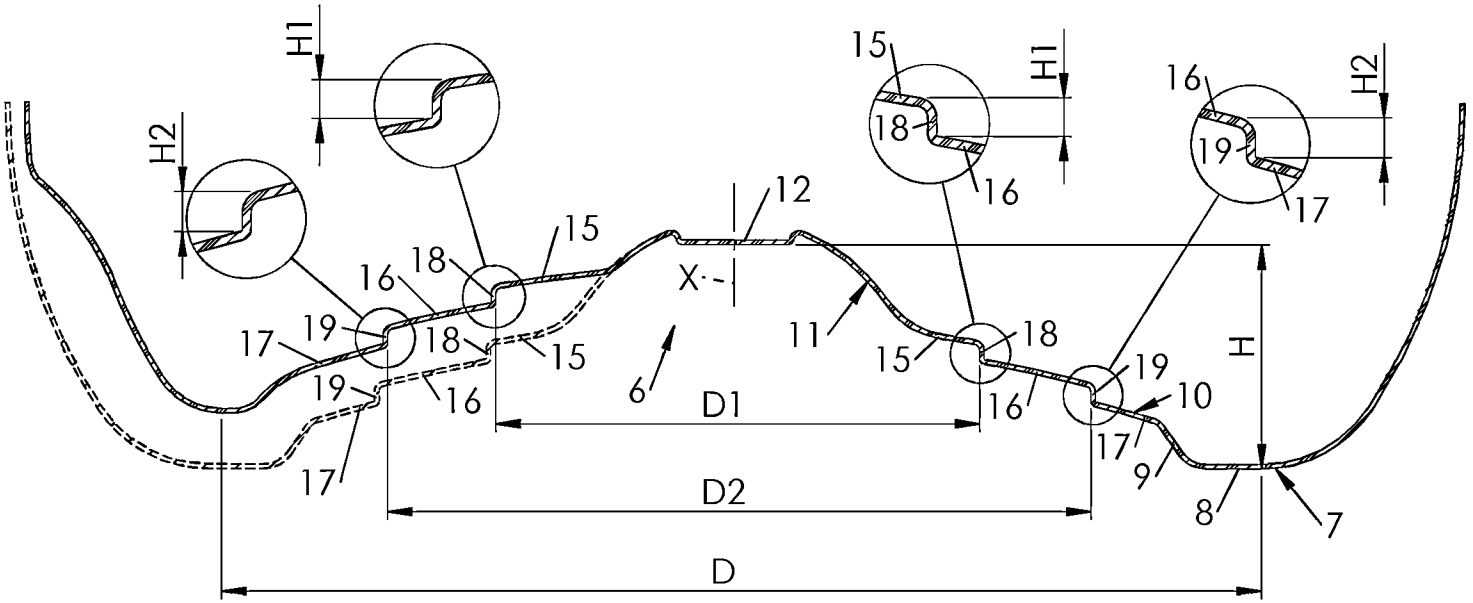
FIG. 5 is a central cutaway view of the bottom of FIG. 3, along the cutting planes IV-IV (in solid lines) and V-V (in dotted lines).

Denoted H is the height (or depth) of the bottom 6, measured between the contact plane 8 and the button 12 (FIG. 5). In the example illustrated, corresponding to a container with a capacity of 0.5 liter, the height H of the bottom is about 10 mm.

According to a preferred embodiment, the bottom 6 is further provided with a series of interposed reinforcing grooves 14, located between the main grooves 13 and that extend locally straddling the footing 7 that they thus help to stiffen. As represented in FIGS. 2 and 3, the interposed ribs 14 extend toward the exterior beyond the footing 7 by rising onto a lower part of the body 5, like the main grooves 13. It is also seen in FIGS. 2 and 3 that the interposed ribs 14 overlap the rim 9 but are interrupted at the periphery of the vault 10.

As is seen in the figures, and more clearly in FIGS. 2, 4 and 5, the vault 10 has three concentric regions, namely an annular central region 15 surrounding the central area 11 of the bottom 6, an annular middle region 16 surrounding the central region 15, and an annular peripheral region 17 surrounding the middle region 16 and extending to the rim 9.

The regions 15, 16, 17 are arranged in tiers and are separated in pairs by steps, namely an inner step 18 separating the central region 15 and the middle region 16, and an outer step 19 separating the middle region 16 and the peripheral region 17.

The inner step 18 extends axially over a predetermined height H1. Likewise, the outer step 19 extends axially over a predetermined height H2. According to a preferred embodiment, the heights H1 and H2 are relatively small relative to the height H of the bottom and, especially, relative to the outer diameter D of the contact plane:

$$0.02D \leq H1 \leq 0.04D$$

$$0.02D \leq H2 \leq 0.04D$$

With, preferably:

$$H1 \cong 0.3D$$

$$H2 \cong 0.3D$$

The steps 18, 19 both extend continuously, i.e., they are not interrupted at right angles to the main grooves 13 and the interposed grooves 14 but extend to the bottoms thereof.

The steps 18, 19 extend annularly in a concentric manner around the central area 11. In the embodiment shown, where the container 1 has an approximately cylindrical shape rotationally around its axis X, the steps 18, 19 form rings having a circular contour, the respective diameters of which are denoted D1 and D2. In already-mentioned variants, where the container 1 would have a polygonal contour in cross-section, the steps 18, 19 would also have a polygonal contour, homothetic to the outside contour of the container 1. D1 and D2 then would designate the diameters of the circles that are inscribed in the polygonal contours of the steps.

By the presence of the inner step 18, the central region 15, although having a radius of curvature approximately identical to that of the middle region 16, is slightly raised relative to it, while being offset toward the interior of the container 1. Likewise, by the presence of the outer step 19, the middle region 16, although having a radius of curvature approximately identical to that of the peripheral region 17, is slightly raised relative to it, while being offset toward the interior of the container.

According to one embodiment, the diameter D1 of the inner step 18 is between 30% and 40% of the outer diameter D of the contact plane 8. In the example illustrated, the ratio D1/D is about 37%.

Moreover, the diameter D1 of the outer step 19 is preferably between 50% and 60% of the outer diameter D of the contact plane 8. In the example illustrated, the ratio D2/D is about 54%.

As for the respective heights H1 and H2 of the steps 18 and 19, they are approximately constant over their contours, while being advantageously between 0.8 mm and 1.5 mm. For a container with a capacity of 0.5 liter (corresponding, as we have seen, to the example illustrated), the heights H1 and H2 are rather between 0.8 mm and 1 mm, and preferably about 1 mm.

The steps 18, 19 have the function of maintaining the stability of the container 1 under restrictive pressure conditions, particularly when an overpressure prevails in the container 1 that is caused by introduction, prior to capping, of a drop of neutral gas (particularly nitrogen) intended to maintain the stiffness of the body 5. More specifically, the steps 18, 19 have the function, by the introduction into the bottom 6 of an axial component, of increasing the pressure threshold beyond which the bottom 6 is made to pop out. The small height of the steps 18, 19 proves sufficient to improve the performance of the bottom 6, while guaranteeing for it a good blow-moldability, benefitting the ease of forming and pressure savings. In practice, having an equal amount of material, the bottom 6 thus designed can be formed under the same pressure conditions as the one described in the aforementioned patent EP 2 133 277.

The steps 18 and 19 actually oppose the complete inversion of the bottom 6 by causing a stiffening of the vault 10 in its middle region, and by limiting the deformation of the vault 10 so as to expand the footing 7 toward the center of the bottom 6. At most, the bottom 6 in fact undergoes a sagging but in a controlled way, the peripheral region 17 (optionally paired with the middle region 16) then forming a secondary footing by which the container 1 can stand in a stable manner on a support surface.

A container 1 made of PET corresponding to the shape illustrated, with a capacity of 0.5 liter and with a weight of 9 g, has been able to be blow-molded without difficulty at an air pressure of 19 bar, the final container 1 filled with still water offering good mechanical performances under the above-mentioned overpressure conditions (adding a drop of nitrogen causing an overpressure of 1 bar in the container). The container 1 is sufficiently stiff to be able to be palletized without danger of collapsing the pallet.

An increase in the height H1 and H2 of the steps 18, 19 could increase the stiffness of the bottom 6, but at the same time would result in a decrease in its blow-moldability in the area of the steps 18, 19, except to give them clearance, which would then reduce the stiffness of the bottom 6.

The container 1 provided with such a bottom 6 thus offers a good compromise between the mechanical performances (i.e., the capacity of the container 1 to withstand deformations and, when they do occur, to undergo them in a controlled manner) and the blow-moldability (i.e., the ability of the container 1 to be formed by blow-molding).

The invention claimed is:

1. A container (1) of plastic material, provided with a body (5) and with a bottom (6) extending from a lower end of the body (5), the bottom (6) comprising:

a peripheral footing (7) that defines a contact plane (8) having an outer diameter (D);

a concave vault (10) that extends from a central area (11) to the peripheral footing (7); and a series of main reinforcing grooves (13) that extend radially from the central area (11) to at least the peripheral footing (7), wherein the vault (10) has three concentric regions, namely a central region (15), a middle region (16), and a peripheral region (17), separated respectively by an inner axial step (18) and an outer axial step (19) that extend annularly in a continuous manner around the central area (11), ensuring that the central region (15) is raised relative to the middle region (16), and the middle region (16) is raised relative to the peripheral region (17), wherein, a cross-section of each of the central region (15), the middle region (16), and the peripheral region (17) has a non-zero radius of curvature, and wherein both an external surface of an internal surface of said inner axial step (18) and step outer axial step (19) is stepped with i) the inner axial step (18) being comprised of a first outside vertical step surface and an opposite first inside vertical step surface of a first height (H1), and ii) the outer axial step (19) being comprised of a second outside vertical step surface and an opposite second inside vertical step surface (H2) of a second height, the inner and outer steps (18, 19) opposing an inversion of the bottom (6) by causing a stiffening of the vault (10) in the middle region (16), and by limiting a deformation of the vault (10) so as to expand the footing (7) toward a center of the bottom (6).

2. The container (1) according to claim 1, wherein each of the first height (H1) and the second height (H2) is less than 4% of the outer diameter (D) of the contact plane (8).

3. The container according to claim 2, wherein each of the first height (H1) and the second height (H2) is about 3% of the outer diameter (D) of the contact plane (8).

4. The container according to claim 3, wherein the inner step (18) has a diameter (D1) of between 30% and 40% of the outer diameter (D) of the contact plane (8).

5. The container according to claim 3, wherein the outer step (19) has a diameter (D2) of between 50% and 60% of the outer diameter (D) of the contact plane (8).

6. The container according to claim 2, wherein the inner step (18) has a diameter (D1) of between 30% and 40% of the outer diameter (D) of the contact plane (8).

7. The container according to claim 2, wherein the outer step (19) has a diameter (D2) of between 50% and 60% of the outer diameter (D) of the contact plane (8).

8. The container (1) according to claim 1, wherein each of the first height (H1) and the second height (H2) is about 1 mm.

9. The container according to claim 8, wherein the inner step (18) has a diameter (D1) of between 30% and 40% of the outer diameter (D) of the contact plane (8).

10. The container according to claim 8, wherein the outer step (19) has a diameter (D2) of between 50% and 60% of the outer diameter (D) of the contact plane (8).

11. The container according to claim 1, wherein the inner step (18) has a diameter (D1) of between 30% and 40% of the outer diameter (D) of the contact plane (8).

12. The container (1) according to claim 11, wherein the diameter of the inner step (18) is about 37% of the outer diameter (D) of the contact plane (8).

13. The container according to claim 1, wherein the outer step (19) has a diameter (D2) of between 50% and 60% of the outer diameter (D) of the contact plane (8).

14. The container (1) according to claim 13, wherein the diameter of the outer step (19) is about 54% of the diameter of the contact plane (8).

15. The container (1) according to claim 1, wherein the main reinforcing grooves (13) extend radially beyond the footing (7).

16. The container (1) according to claim 1, wherein the bottom (6) comprises a series of interposed reinforcing grooves (14), which extend locally straddling the footing (7).

17. The container according to claim 1, wherein, each of the central region (15), the middle region (16), and the peripheral region (17) are sloped upward from the footing (7) towards the central area (11) by an outside surface and an opposite inside surface that are sloped upward from the footing (7) towards the central area (11), and the inner axial step (18) vertically raises an outer sloped end of the central region (15) relative to an inner sloped end of the middle region (16) by the first height, and the outer axial step (19) vertically raises an outer sloped end of the middle region (16) relative to an inner sloped end of the peripheral region (17) by the second height.

18. The container (1) according to claim 17, wherein, each of the first height (H1) and the second height (H2) is about 1 mm, and the radius of curvature of the central region (15), the middle region (16), and the peripheral region (17) are approximately identical.

19. The container (1) according to claim 1, wherein, the radius of curvature of the central region (15), the middle region (16), and the peripheral region (17) are approximately identical.

20. A container (1) of plastic material, comprising:

a body (5); and a bottom (6), the bottom (6) comprising i) a peripheral footing (7) that extends into a lower end of the body (5), the footing (7) ending in a contact plane (8) that defines a lower end of the container (1) and allows the container (1) to be placed, upright, on a plane surface, the contact plane (8) having an outer diameter (D);

ii) a concave vault (10) that extends from the peripheral footing (7) to a central area (11) of the bottom (6) located around a button (12); and iii) a series of main reinforcing grooves (13) that extend radially from the central area (11) to at least the footing (7), wherein the vault (10) comprises a central region (15), a middle region (16), and a peripheral region (17), wherein, a cross-section of each of the central region (15), the middle region (16), and the peripheral region (17) has a non-zero radius of curvature, each of the central region (15), the middle region (16), and the peripheral region (17) having an outside surface and an opposite inside surface that are slope upward from the footing (7) towards the button (12), an inner axial step (18) separating the central region (15) and the middle region (16), and an outer axial step (19) separating the middle region (16) and the peripheral region (17), the inner axial step (18) being comprised of a first annular outside vertical step surface and an opposite first annular inside vertical step surface of a first height, the outer axial step (19) being comprised of a second annular outside vertical step surface and an opposite second annular inside vertical step surface of a second height, the inner axial step (18) vertically raising an outer sloped end of the central region (15) to be vertically aligned with an inner sloped end of the middle region (16) by the first height, and the outer axial step (19) vertically raising an outer sloped end of the middle region (16) to be vertically aligned with an inner sloped end of the peripheral region (17) by the second height, the inner and outer steps (18, 19) opposing an inversion of the bottom (6) by causing a stiffening of the vault (10) in the middle region (16), and by limiting a deformation of the vault (10) so as to expand the footing (7) toward a center of the bottom (6).

* * * * *